US008069538B2

(12) United States Patent
Wilcox

(10) Patent No.: US 8,069,538 B2
(45) Date of Patent: Dec. 6, 2011

(54) APPARATUS AND METHOD FOR SECURELY YET REMOVABLY ATTACHING ORNAMENTS TO SHOES, CLOTHING, PET COLLARS AND THE LIKE

(76) Inventor: Robert Wilcox, Lakewood, CO (US)

( * ) Notice: Subject to any disclaimer, the term of this patent is extended or adjusted under 35 U.S.C. 154(b) by 864 days.

(21) Appl. No.: 12/070,776

(22) Filed: Feb. 21, 2008

(65) Prior Publication Data

US 2008/0155788 A1 Jul. 3, 2008

Related U.S. Application Data

(63) Continuation-in-part of application No. 11/373,887, filed on Mar. 10, 2006, now abandoned.

(60) Provisional application No. 60/902,423, filed on Feb. 21, 2007, provisional application No. 61/010,649, filed on Jan. 10, 2008.

(51) Int. Cl.
*A44B 1/32* (2006.01)

(52) U.S. Cl. ..... 24/109; 24/590.1; 24/628; 119/858

(58) Field of Classification Search ..... 24/109, 24/DIG. 59, 90.1, 580.1, 590.1, DIG. 60, 24/DIG. 53, DIG. 56, 628; 36/136, 137; 63/1.11, 1.18, 29.1; 119/858
See application file for complete search history.

(56) References Cited

U.S. PATENT DOCUMENTS

| | | | |
|---|---|---|---|
| 157,348 | A | 12/1874 | Pforzheimer |
| 1,410,916 | A | 3/1922 | Hendrix |
| 1,689,000 | A | 10/1928 | Wagner |
| 1,691,064 | A | 11/1928 | Hoppe |
| 1,888,169 | A | 11/1932 | Hollerer et al. |
| 2,100,106 | A | 11/1937 | Matsumoto |
| 2,118,561 | A | 5/1938 | Kleeberg |
| 2,887,795 | A | 5/1959 | Taicher |
| 2,888,767 | A | 6/1959 | Pinkus |
| 3,343,230 | A | 9/1967 | Darvie |
| 3,390,435 | A | 7/1968 | Zimber |
| 3,401,433 | A | 9/1968 | Marx et al. |
| 3,601,909 | A | 8/1971 | Amendola |
| 3,623,192 | A | 11/1971 | Papazian |
| 3,715,781 | A | 2/1973 | Salvatori |
| 3,867,971 | A | 2/1975 | Hazan |
| 4,457,050 | A | 7/1984 | Kanzaka |
| 4,621,441 | A | 11/1986 | Wagner et al. |
| 4,712,319 | A | 12/1987 | Goria |
| 4,724,628 | A | 2/1988 | Schreiner |
| 4,733,439 | A | 3/1988 | Gentry |

(Continued)

*Primary Examiner* — James Brittain
(74) *Attorney, Agent, or Firm* — Rod D. Baker

(57) ABSTRACT

A decorative charm and fastener system and its method for use upon an item to be worn by the user or a pet animal; the item to be worn may be a shoe, an item of clothing (including shirts, hats and caps, or the like), or a pet collar. The fundamental embodiment features a charm part and a base part that may be connected together on opposite sides of the item to be worn, with the item situated between the base part and the charm part. The system also includes an elastically compressible washer member that is placed upon the charm part. The compressible washer promotes a secure, yet temporary, connection between the charm part and base part when those respective parts are installed upon an item. Assortments of different charms thus are interchangeable for temporary attachment to the base part. Specialized alternative versions of the apparatus are disclosed for use upon the shoelaces of a shoe, as a pet collar. A variety of decorations accordingly may selectively be used in combination with a shoe, pet collar, or other item.

17 Claims, 15 Drawing Sheets

U.S. PATENT DOCUMENTS 4,837,960 A 6/1989 Skaja
4,864,736 A 9/1989 Bierk
4,928,362 A 5/1990 Collas et al.
5,077,989 A * 1/1992 Dillabaugh ..... 63/29.1
5,097,679 A 3/1992 Johnson et al.
5,136,726 A 8/1992 Kellin et al.
5,214,826 A 6/1993 Fortune
5,295,315 A 3/1994 Osawa et al.
5,308,671 A 5/1994 Wells
5,402,589 A 4/1995 Lubrani et al.
5,412,852 A 5/1995 Smaragdas
5,456,095 A * 10/1995 Tawil et al. ..... 63/29.1
5,459,909 A * 10/1995 Nussberger ..... 24/574.1
5,673,501 A 10/1997 Mathews
5,852,885 A 12/1998 Ferniani
5,933,929 A 8/1999 Kawakami et al.
5,979,085 A 11/1999 Ross et al.
6,012,203 A * 1/2000 Baron Pearson ..... 24/114.9
6,058,573 A 5/2000 Silver
6,115,948 A 9/2000 Mitchell
6,266,853 B1 7/2001 Ho
6,357,093 B1 3/2002 Takahashi
6,412,151 B1 7/2002 Rowland
6,568,044 B1 5/2003 Kidd
D475,322 S 6/2003 Ouellette et al.
6,640,464 B2 11/2003 Hsin et al.
6,729,058 B2 5/2004 Ferguson
6,769,204 B1 8/2004 Phillips
D554,847 S 11/2007 Schmelzer et al.
7,698,836 B2 * 4/2010 Schmelzer et al. ..... 36/136
2003/0221334 A1 12/2003 McFee
2004/0231190 A1 11/2004 Seamans
2005/0016028 A1 1/2005 Safdeye
2005/0039345 A1 2/2005 Jones et al.
2006/0007668 A1 * 1/2006 Chien ..... 362/103
2006/0179689 A1 8/2006 Thompson et al.
2007/0084019 A1 4/2007 Wilcox et al.

* cited by examiner

APPARATUS AND METHOD FOR SECURELY YET REMOVABLY ATTACHING ORNAMENTS TO SHOES, CLOTHING, PET COLLARS AND THE LIKE

CROSS-REFERENCE TO RELATED APPLICATIONS

This application is a continuation-in-part of U.S. Utility patent application Ser. No. 11/373,887 entitled "Ornamental Rivet Apparatus Especially for Clothing or Shoes," filed on Mar. 10, 2006 now abandoned, the entire disclosure of which is incorporated herein by reference. This application also claims the benefit of the filing of U.S. Provisional Patent Application Ser. No. 60/902,423, entitled "Method and Apparatus for Attaching Ornaments to Pet collars and the Like," filed on Feb. 21, 2007, and the specification thereof is incorporated herein by reference. This application also claims the benefit of the filing of U.S. Provisional Patent Application Ser. No. 61/010,649, entitled "Method and Apparatus for Attaching Ornaments to Pet collars and the Like," filed on Jan. 10, 2008, and the specification thereof is incorporated herein by reference.

BACKGROUND OF THE INVENTION

1. Field of the Invention (Technical Field)

The present invention relates to fasteners, particularly to fasteners with decorative features, and more specifically to apparatuses permitting the use of interchangeable ornamental charms on shoes, leather goods, pet collars, clothing, and the like.

2. Background of the Invention

People have attached ornaments to their clothing and footwear, including shoes, for centuries. The present invention was developed to provide for interchangeability of ornamental charms, especially on footwear, clothing, clothing accessories, and pet collars.

Sandals and other types of open-toed and/or open-heeled shoes are rising in popularity among peoples of many countries, including the women and girls of the United States. One type of shoe recently very popular is a beach shoe or sandal offered under the trademark CROC. CROC brand footwear includes an open-heeled sandal manufactured from a lofted foam plastic material. Such sandals have a strap pivotally attached to the sandal upper by means of a recited connection. The present apparatus is ideally suited for use in combination with CROC brand beach sandals.

It is known to provide ornaments for use on items, including clothing and shoes. Some publications providing useful background reference, including some teaching interchangeable ornaments, include the following: U.S. Patent Publication No. 2005/0016028 to Safdeye; U.S. Patent Publication No. 2003/0221334 to McFee; U.S. Design Pat. No. D475,322 to Ouellette et al.; U.S. Pat. No. 6,412,151 to Rowland; U.S. Pat. No. 5,673,501 to Mathews; U.S. Pat. No. 4,724,628 to Schreiner; U.S. Pat. No. 4,712,319 to Goria; U.S. Pat. No. 3,343,230 to Darvie; and U.S. Pat. No. 1,689,000 to Wagner.

Further, it would be desirable to provide an fastener apparatus permitting interchangeability of decorative charms, emblems, or other ornaments that is useable not only on shoes, but upon other items of clothing, or even on other items (such as hats and caps) worn by people, or by (such as collars) pets.

Moreover, it would be desirable to provide a means and method for securely yet removably attaching ornaments to shoes, clothing, pet collars and the like. In many of the prior art methods and devices, the ornament attachment is either too difficult to manipulate, especially for children, or does not provide a means and mode of attachment that provides for a secure and reliable connection of the ornament, yet one which can be readily detached when desired. Against this background, the method and apparatus of the present disclosure were developed.

SUMMARY OF THE DISCLOSURE

There is disclosed a decorative fastener for use upon an item to be worn by the user; the item to be worn may be a shoe, an item of clothing (including shirts, hats and caps, or the like), a leather or synthetic bracelet, a leather, nylon webbed or synthetic pet collar, leather or synthetic pet leashes, leather or synthetic cell phone straps, key chain holders, or the like. The fastener features two parts that may be reversibly interconnected on opposite sides of the item to be worn, with the item situated between the bottom part and the top part. The connection between parts is provided by a twist-lock mechanism, which permits a secure connection, and yet allows the parts easily to be disconnected and detached for replacement. There preferably is provided a resilient washer member between a base and ornamental portion, which though compressive forces increases the reliability of the interconnection among apparatus parts. The ornament portion thus is attachable temporarily to one side of the top part, there being decoration of any desired type or appearance on the ornament portion. Assortments of different ornament portions accordingly are interchangeable for temporary attachment to the top part. A variety of decorations accordingly may selectively be used in combination with the shoe, pet collar or other item.

BRIEF DESCRIPTION OF THE DRAWINGS

The accompanying drawings, which are incorporated into and form a part of the specification, illustrate several embodiments of the apparatus disclosed hereby and, together with the description, serve to explain the principles of the apparatus and related methods. The drawings are only for the purpose of illustrating a preferred embodiment of an apparatus according to this disclosure, and are not to be construed as necessarily limiting the scope of the appended claims. In the drawings:

DESCRIPTION OF THE PREFERRED EMBODIMENTS

Best Modes for Carrying Out the Invention

There is disclosed hereby an interchangeable ornament method and apparatus for use on clothing or footwear, particularly on shoes, as well as upon simple pet collars. In its simplest embodiment, the apparatus is well-suited for use upon shoes having holes defined through the shoe upper. One version of the disclosed apparatus is specially configured for use with shoe laces. A pet collar specially configured for the practice of the invention also is disclosed. A charm fastening system according to the present disclosure may be used in a shoe at the time the shoe is manufactured. It is contemplated, however, that the charm fastener of this disclosure be used by consumers in the "after-market" to replace rivets installed by the shoe manufacturer. The present apparatus, when installed upon a shoe or other item, permits a user to use a charm fastener to decorate an item such as a shoe, pet collar, or other item.

It shall be understood that while one contemplated use for one embodiment of the disclosed apparatus is upon shoes, such as CROC® brand shoes, the apparatus may find utility upon a wide variety of items of clothing, including headwear. Further, embodiments of the methods and apparatus disclosed are suitable for use in other contexts, such as upon dog or cat collars.

In this disclosure and in the claims, reference will be made to an "item" upon which, or in combination with which, the inventive apparatus and method may be practiced. Such an item particularly includes a shoe, but also may be an item of clothing or a hat to be worn by an individual person, or a flexible bracelet. An item may also be a leather or synthetic pet collar to be worn by pets such as dogs or cats, leather or synthetic pet leashes, or even leather or synthetic cell phone straps, or leather or synthetic key chain holders.

Advantageously, the method and apparatus permit interchangeability of ornamentation, whereby the user—typically the end-user consumer—can remove and replace various different ornaments. Interchangeable ornaments provide variability of ornamentation from day-to-day, or to customize ornamentation to complement the user's attire, or to adapt ornaments to a function the user will be attending. Also, ornamentation can be provided which comports with the breed or name, for example, of a pet wearing a collar according to the present disclosure.

The apparatus of this disclosure potentially may be used with nearly any kind or type of clothing item or shoe. One item of footwear ideally suited for use in conjunction with one of the disclosed embodiments of the present apparatus is shown by U.S. Patent Publication No. 2004/0231190, to Seamans, published on Nov. 25, 2004. The Seamans footwear apparatus is a sandal or "clog" type of footwear, having an open heel and a semi-open upper toe portion connected to a sole having a low heel. A strap is pivotally connected to the upper by means of a pair of rivets.

Figure 1:
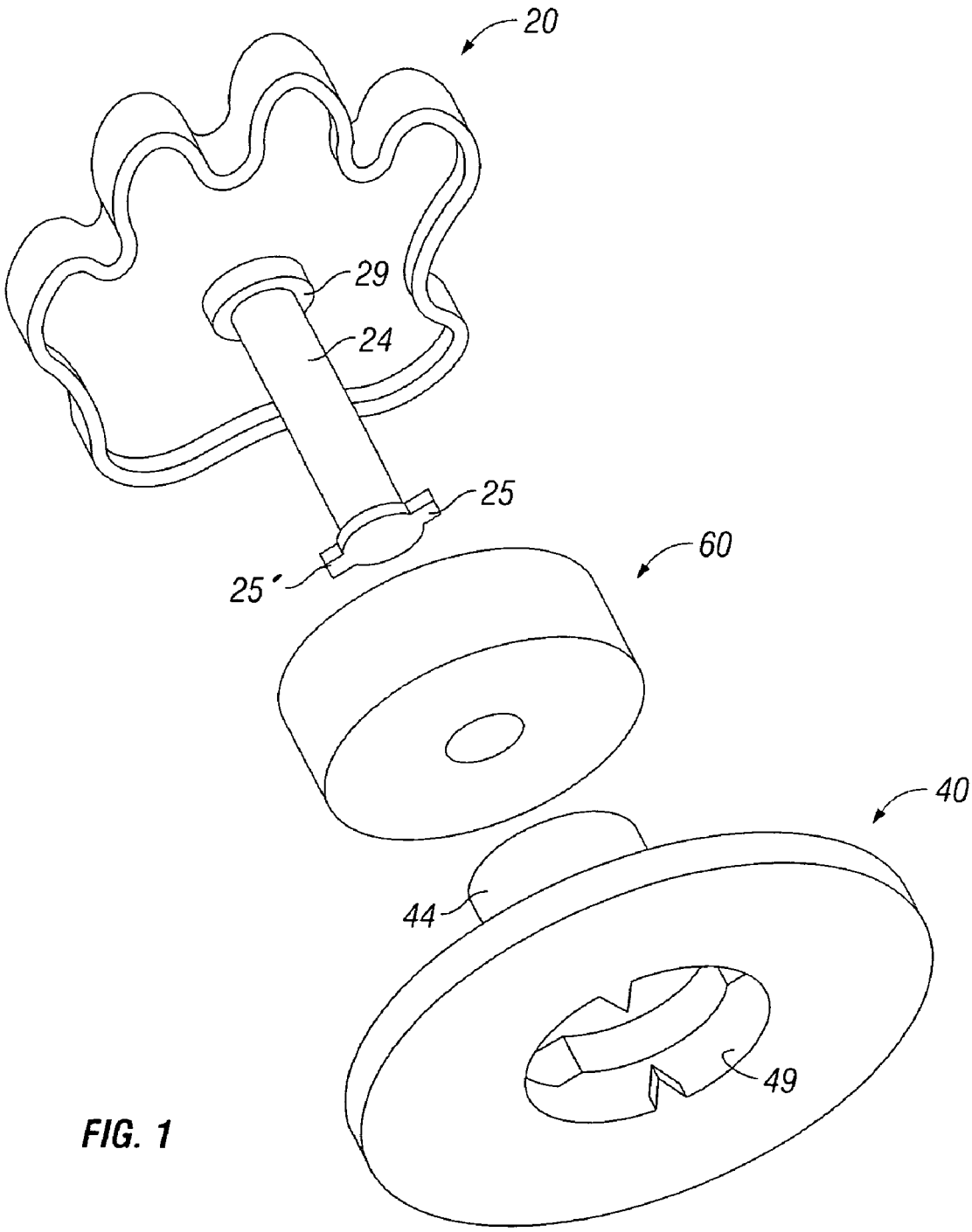
FIG. 1 is an enlarged exploded perspective view of one preferred, fundamental, embodiment of the apparatus according to the present disclosure, showing a charm component, an intermediate compressible washer, and a base component.

One preferred embodiment of an apparatus according to this disclosure is depicted in the drawing figures, to which reference now is made. As seen in FIG. 1, the fundamental version of the apparatus includes three main components: a charm member 20, a base member 40, and a compressible O-ring or washer 60. These components are inter-engageable with one another, and are assembled cooperatively to define the fundamental apparatus as described hereinafter.

The charm 20 preferably is an integral single piece, and preferably is manufactured from a metal alloy, but alternatively may be molded in plastic or fashioned from any other suitable rigid or semi-rigid material. Most of the components of the present apparatus preferably are fabricated from die-cast metals or durable plastic, e.g., injection-molded polypropylene or polyethylene, or other suitable plastics. It is readily understood, however, that the apparatus may be crafted from other materials. For example, the components may be fashioned from metals for use on a pet collar. If desired, a "high end" apparatus could even be crafted from a precious or semi-precious metal alloy.

Figure 2A:
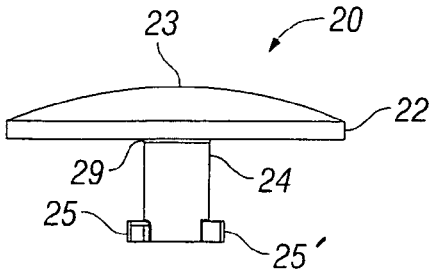
FIG. 2A is a front view of a charm component of an apparatus according to the present disclosure.
Figure 2B:
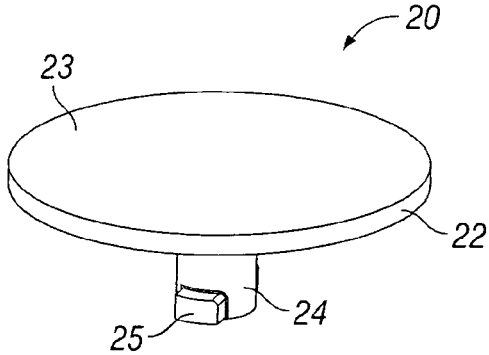
FIG. 2B is a perspective top view of the charm component of an apparatus according to the present disclosure.
Figure 2C:
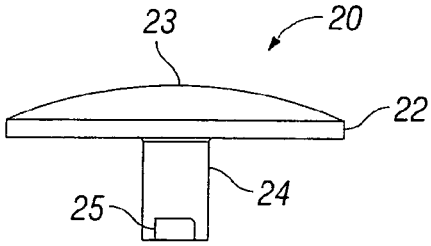
FIG. 2C is a side view of the charm component seen in FIG. 2A, rotated ninety degrees (around a vertical axis) relative to FIG. 2A.
Figure 2D:
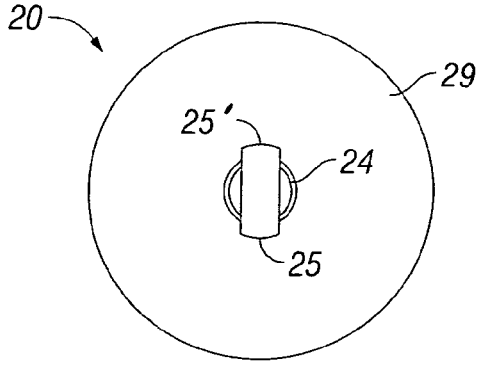
FIG. 2D is a bottom view of the charm component of an apparatus according to the present disclosure.

FIGS. 2A-2D and 4 depict a charm 20 simplified in appearance (compared to FIG. 1) for facility of illustration. It will be immediately understood, however, that charm 20 can assume any of a practically limitless variety of shapes, sizes, colors, and decorative appearances. Referring to FIGS. 1-2D, it is seen that the charm 20 has a head 22 and a stem 24. The stem 24 preferably is permanently attached to, and preferably extends generally perpendicularly from, the center of the underside or bottom of the head 22. The head 22 has an upper surface 23 upon which a decorative, ornamental, or informational logo, emblem, indicium, image or artwork may be embossed, engraved, painted, dyed, affixed or otherwise provided according to any means known in the art. Alternatively, the charm 20 may itself fully embody the ornament or decoration desired.

Again, FIGS. 2A-2D and 4 suggest that the head 22 be round or circular in plan view, but it is immediately understood that the head can have practically any shape, including oval, star-shaped, square, triangle, etc. FIG. 1 suggests, for example, that the head 22 can be provided with an ornamental profile such as a paw print, or other selected contour and shape, either abstract or representational.

As best seen in FIGS. 1 and 2A-2D, the distal end of the stem 24 is provided with at least one, preferably two, radially extending locking stubs 25, 25'. Each of two locking stubs 25, 25' preferably is disposed diametrically opposite of the other on the distal end of the stem. The stubs 25, 25' preferably are molded integrally with the stem 24 to be unitary therewith, but alternatively may be securely affixed to the stem in the appropriate location(s).

The base 40 is best seen in FIGS. 1 and 3A-3F. The base member is of one-piece, generally rigid construction, and preferably is fashioned from a durable, hard plastic. Other embodiments of the base rivet can be manufactured from alternative, generally rigid and unbreakable, desirable materials. As suggested by the drawing figures, the base 40 preferably, but not necessarily, has a generally circular plan profile, although other shapes are possible and fall within the scope of the present invention. The base 40 has a base flange 42, which optionally may be round and somewhat cap-like, integral with or permanently connected to a coupling body 44. The coupling body 44 preferably is generally cylindrical in shape, and projects from the center of the top of the base flange 42.

Figure 3A:
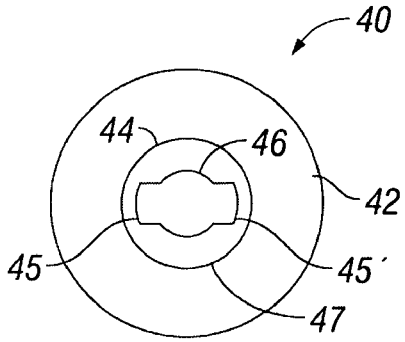
FIG. 3A is a top plan view of a base component of an apparatus according to the present disclosure.
Figure 3B:
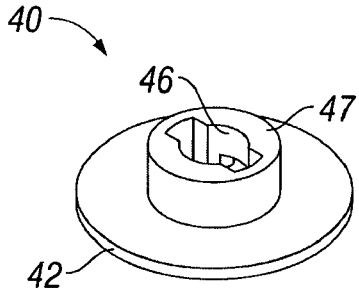
FIG. 3B is a perspective top view of the base component of an apparatus according to the present disclosure.
Figure 3C:
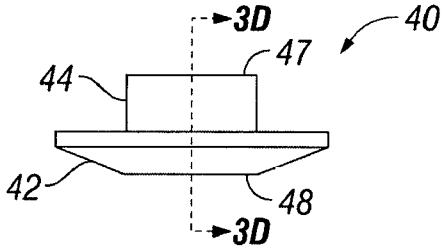
FIG. 3C is a side view of a base component of an apparatus according to the present disclosure.
Figure 3D:
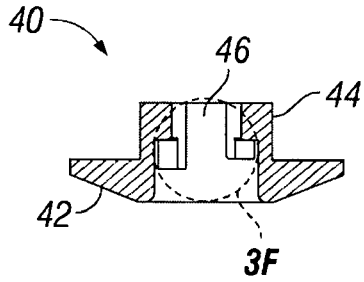
FIG. 3D is a sectional view of the base component seen in FIG. 3C, taken along section 3D-3D in FIG. 3C.
Figure 3E:
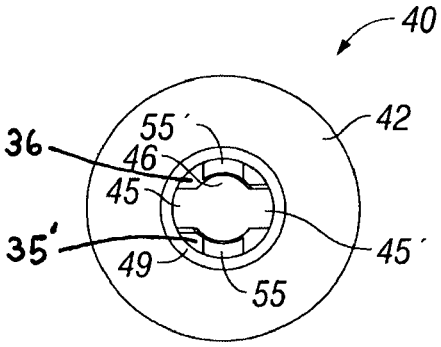
FIG. 3E is a bottom view of a base component of an apparatus according to the present disclosure.

The coupling body 44 has a central tunnel-like aperture 46 running its axial length, into which the stem 24 of the charm 20 can be inserted whereby to connect the charm 20 to the base 40. As best seen in FIGS. 3A, 3B, and 3E, the shaft aperture 46 has a central circular portion and a pair of parallel, diametrically opposed, channels or grooves 45, 45' axially coextensive with the central circular portion. The diameter of the circular central portion of the aperture 46 is slightly greater than, but corresponds closely to, the diameter of the stem 24 of the charm 20. Similarly, the plan shape and size of the aperture grooves 45, 45' correspond generally to the exterior plan contours of the stem stubs 25, 25'. Consequently, when the stubs 25, 25' are placed in registration with the aperture grooves 45, 45', and the stem 24 is aligned with the axis of the aperture 46, the charm's stem 24 can be smoothly inserted into the aperture 46. The overall length of the stem 24 is about equal to, or more preferably slightly less than, the total height of the base 40 component. When the stem 24 is maximally inserted into the aperture 46 (e.g., when the top end 47 of the coupling body 44 butts against the underside of the charm head 22), the distal end of the stem 24 preferably is approximately flush with the bottom 48 of the base 40.

Figure 4:
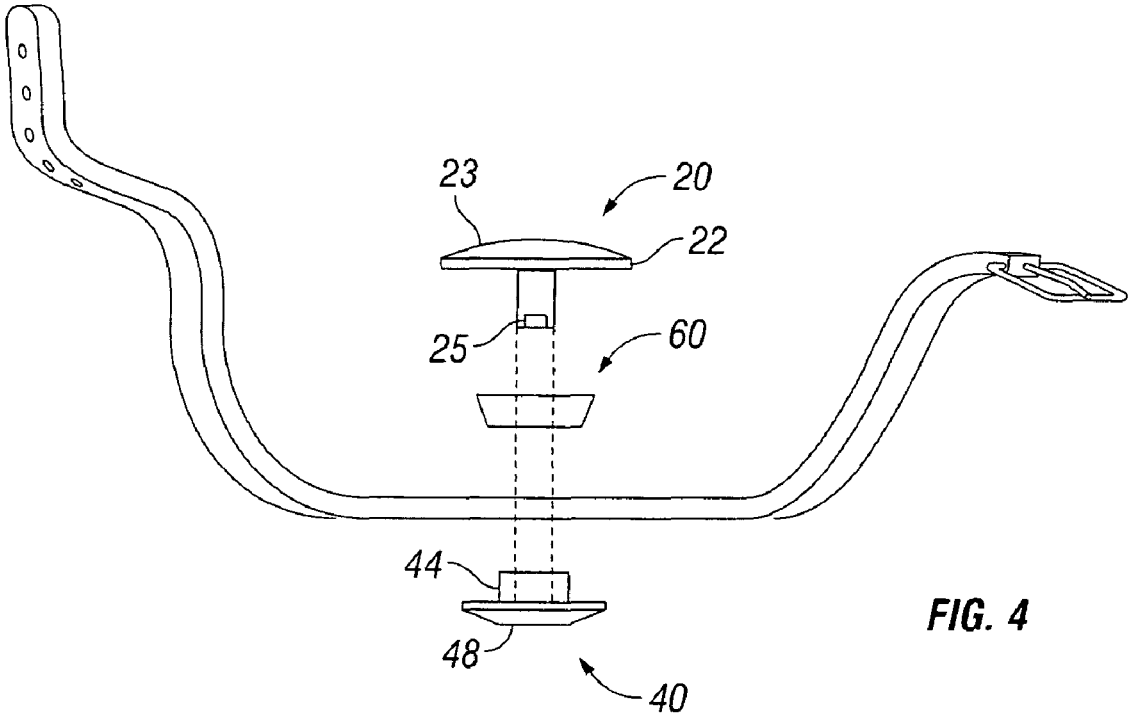
FIG. 4 is a side exploded view of a fundamental apparatus according to the present disclosure, showing how the apparatus is attachable to a simple pet collar by disposing the apparatus through a hole in the collar.

As indicated by FIGS. 1 and 4, the aperture 46 through the base 40 is configured to receive the stubs 25, 25' and stem 24, such that when the stem is fully inserted into the aperture, a twist or turn of the charm 20 will engage the stubs 25, 25' with associated notches 55, 55' or detents in the base member 40 to releasably lock the base and charm 20 together.

Attention is invited to FIGS. 3A and 3D-3F, showing that one possible version of the interior of the bottom end of the aperture 46 in the base 40 is specially configured to promote a releasable locking engagement between the stem 24 of the charm 20 and the base. There is provided in the bottom of the base 40 a recess 49 (which may be circular in overall plan shape). In the floor of the recess 49 are defined two notches 55, 55', corresponding generally in shape and size to the exterior contours and sizes of the two stubs 25, 25' on the distal end of the stem 24. Thus in a bottom view (FIG. 3E) the notches 55, 55' have about the same dimensions as the aperture grooves 45, 45'; the grooves 45, 45', however, extend the complete axial height of the base 40, while the notches 55, 55' have an axial extent (depth) corresponding approximately to the much shorter height of the stubs 25, 25'. The notches 55, 55' are angularly offset (i.e., situated along different radii) from the grooves 45, 45'. This offset, depicted in FIG. 3E, preferably is about ninety degrees (90°) from the grooves 45, 45'.

Figure 3F:
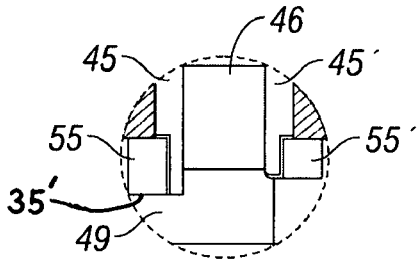
FIG. 3F is an enlarged view of a portion of the base component designated in FIG. 3D, with details enlarged for clarity of disclosure.

In an optional but preferred embodiment of the base 40, the notches 55, 55' are specially configured to promote easy engagement of the stubs 25, 25' therein during connection of the charm to the base. Each notch is limited by a sidewall on either side thereof, defined in the interior of the coupling body 44 and within the recess 49. As best seen in FIGS. 3E and 3F, the wall on one side of each notch 55, 55' is slightly higher than the wall delimiting the opposite side of that notch. Referring to FIGS. 3E and 3F, the high wall portion 35' on a first side of notch 55 is higher (i.e., has greater axial extent, perhaps reaching the bottom surface 48 of the base 40) than the other lower wall portion 35 on the other side of the notch 55. Similarly, but in a diametric reversal, the high wall portion 36' on a first side of the opposite notch 55' is higher than the low wall portion 36 on the other side of that second notch 55'.

By so configuring the notches 55, 55' in the base, the engagement of the stubs into the notches is facilitated. The higher wall portions 35' and 36' are high enough that the stubs 25, 25' contact them when the stubs are rotated in the recess 49. When a stub contacts a higher wall portion, it tends to drop into immediate engagement with the notch directly below. Thus, the higher wall portions 35' and 36' help prevent the stubs from "overshooting" the notches 55, 55' while the user is twistable rotating the charm stem 24 in the aperture 46. For example, and having reference to FIG. 3E, if the stubs are being rotated in the recess 49 in a clockwise direction (as seen in FIG. 3E), the respective stubs pass over the lower wall portions 35 and 36, but with continued rotation come into contact with and are arrested by the higher wall portions 35', 36'; sensing this impediment to over-rotation past the notches 55, 55', the user knows that the stubs are in registration with the notches and can release compression on the washer 36 to permit its elastic rebound to push the stubs into the notches 55, 55', thus releasably locking together the charm 20 and the base 40.

The washer 60 in the apparatus functions as a spring or biasing member which, when compressed, urges the base 40 and charm 20 away from each other to promote a releasable, locking engagement between the charm and base, as shall now be further described.

The O-ring or washer 60 is seen in FIGS. 1 and 4. The washer 60 is elastically compressible, and is devised to be disposed around the stem 24 of the charm 20. The central aperture in the washer 60 has a diameter approximating the diameter of the stem 24, so that when the washer is in place around the stem, it is in snug contact therewith. The outside, larger diameter of the washer 60 is greater than the outside diameter of the coupling body 44, but less than the maximum diameter of either the head 22 or the base flange 42. In a preferred embodiment, the washer is composed of resilient silicone, or a rubber compound of silicone, although other elastically compressible materials may be substituted. The washer 60 in a preferred embodiment has a thickness (or axial height relative to the axis of the stem 24) of between about 2.5 mm and about 3.0 mm, where the stem 24 extends about 6.0 mm from the bottom of the charm head 22. In one very preferred embodiment, the axial thickness of the uncompressed washer is 2.5 mm. The thickness of the washer 60 is adjusted according to the absolute size of the apparatus, and in accordance with the features and functions of the apparatus as disclosed further herein. With such a very preferred embodiment, the inside diameter (i.e., of its central aperture) of the uncompressed washer 60 is approximately 3.5 mm, and its outside diameter is approximately 7.5 mm. The specified durometer of the washer 60 preferably is between about 35 and about 45 durometer, most preferably about 40 durometer hardness.

In the assembled apparatus, the washer 60 is stretched over the stubs 25, 25' and then slipped down the stem 24 into abutting contact with the underside of the head 22 of the charm 20. Thus, as suggested by FIGS. 1 and 4, and seen in FIG. 7, in the fully assembled apparatus the washer 60 is snuggly situated around the stem 24 in contact with the underside 29 of the head 22 of the charm. It remains in place by frictional engagement with the stem, and also by the stubs 25, 25', whose total lateral extent exceeds the diameter of the central aperture in the washer 60.

It was determined that a washer 60 or other elastically compressible member having a hardness of between 35 and 45 durometer is particularly well-suited to the facile practice of the present invention. With an elastically compressible washer 60 within this range of durometer hardness, the washer is sufficiently compressible that it is not unduly difficult for the user, even a child, to squeeze the washer between the head 22 of the charm 20 and the base 40 during the practice (connection and disconnection) of the invention, yet the resilient rebound of the washer exerts an adequate compressive force to securely urge the charm stubs 25, 25' into the corresponding notches 55, 55' of the base. This unexpected advantage promotes use of the invention by a wide variety of users, including children, while nevertheless providing a connection between charm 20 and base 40 that is not prone to accidental disconnection and separation.

To releasably connect the charm 20 and base 40 together, the stem 24 is brought into axial alignment with the base aperture 46, with the stubs 25, 25' in registration with the aperture grooves 45, 45'. The stem 24 is smoothly inserted into the aperture 46, with the stubs 25, 25' sliding along the grooves 45, 45'. This sliding insertion is continued until the distal end of the stem 24 emerges from the bottom end of the aperture 46; at this juncture, the distal end of the stem, with its extending stubs, is within the space of the recess 49 in the base 40. The stubs 25, 25' are no longer within the grooves 45, 45' and are disengaged there from. Also at this juncture, the washer 60 is resiliently compressed between the top end 47 of the coupling body 44 and the underside 29 of the charm head 22. This compression is maintained briefly by the manual manipulation of the user. The compressed washer 60 tends to increase the distance between the charm head 22 and the top 47 of the coupling body 44.

With the washer 60 compressed, the stubs 25, 25' are free to rotate within the recess space 49. While manually maintaining the compression of the washer 60, the user rotates the charm 20, thus also rotating the stem 24 in the aperture 46. This twisting rotation is through an angle corresponding to the offset between the grooves 45, 45' and the notches 55, 55'; in the preferred embodiment, this angle of rotation equals about ninety degrees. The angular (e.g., ninety-degree) rotation brings the stubs 25, 25' into alignment with the notches 55, 55'. The user then releases the charm 20 to decompress the washer 60, allowing the resilient washer to rebound to its original, rest, condition and dimensions. The rebounding expansion of the washer 60 pushes the base 40 away from the charm 20 and withdraws the stem 24 back into the aperture 46. This withdrawal motion causes the stubs 25, 25' to pull into and engage with the notches 55, 55'; the charm 20 and base 40 move slightly further apart under the bias of the compressed washer 60 until the stubs 25, 25' "bottom" in the notches 55, 55'. At the engagement of the stubs into the notches, the separating motion ceases, and the charm 20 and base 40 are securely, yet releasably, connected.

Additionally and significantly, the length of the stem 24 and the comparative lengths of the aperture 46 and coupling body 44 are predetermined, and these features designed, such that when the stubs 25, 25' are engaged in the notches 55, 55', the washer 60 continues to be in a state of mild compression, thus tending to hold the stubs 25, 25' within the notches 55, 55'. In its mildly compressed state, the washer 60 maintains the connective inter-engagement between the charm 20 and the base 40. The compressive force urging the stubs 25, 25' into the notches 55, 55' of the base 40 yields a significantly more reliable connection than yielded by prior art designs.

To disconnect the charm 20 from the base 40, the user merely squeezes the charm and base together (i.e. towards each other) to compress further the washer 60 between them. This added compression of the washer, with the concordant decrease in separation distance between the charm 20 and the base 40, causes the stubs to emerge from the notches 55, 55' in the recess 49 within the base 40. Holding the washer in this state of added compression, the user simply rotates the charm (or the base) ninety degrees to register the stubs 25, 25' with the aperture grooves 45, 45'. With the stubs and grooves 45, 45' in registration, the stem 24 can be withdrawn through and along the complete length of the coupling body 44, and the charm 20 completely separated from the base 40.

In summary, the fundamental decorative apparatus is removably attachable to an item, and features a charm 20 having a head 22, a stem 24 extending a certain stem length from the bottom 29 of the head, and at least one (preferably two) stub 25 extending laterally from a distal end of the stem 24. There is provided an elastically compressible member 60 disposable around the stem 20, and a base 40 member featuring a base flange 42, a coupling body 44 extending a certain shaft length from the flange 42, and a tunnel-like aperture 46, along the shaft length of the body 44, into which the stem 24 is insertable. The aperture 46 has a central portion along a central axis, and at least one (preferably two) side groove 45 axially coextensive the central circular portion, into which the at least one stub is slidably engageable. Also on the bottom of the base 40 there is defined a recess 49, there being least one (preferably two) notch 55 defined in a floor of the recess. The notch or notches 55, 55' substantially correspond in shape and size to associated stubs 25, 25' on the stem 24. The each notch is angularly offset an equal amount in relation to on associated one of the two channels 45, 45'.

Thus, when the stubs 25, 25' are placed in registration with the grooves 45, 45', and the stem 24 is aligned axially with the aperture 46, the stem is insertable into the aperture. When the stem is fully inserted into the aperture, the compressible member 60 is compressed between the charm head 22 and the base flange 42. And when the stem 24 is fully inserted into the aperture 46, the stem is rotatable within the aperture, and the stubs 25, 25' are rotatable within the space of the recess 49, to align and engage each stub with a corresponding notch, thereby to releasably connect the charm to the base. The biasing action of the elastically compressive member 60 then holds the stubs 25, 25' within the notches 55, 55'.

The apparatus accordingly is useable to releasably attach one or more decorative or informational items to, for example, a pet collar (FIG. 4), or other clothing or fashion accessory item. The item to which the apparatus is releasably connected need merely to be fairly thin, and to have a hole therein through which the stem 24 may be inserted. With the charm 20 on one side of the item and the base rivet on the other side, the stem 24 is pushed through the hole in the item. The stem 24 extending through the item then is aligned with the aperture 46 of the base 40, and the stem is inserted into the aperture and then twisted ¼-turn as described above to releasably interconnect the charm and rivet.

The use of an annular washer 60 disposed concentrically about the stem 60 of the charm 20 offers advantages over other possible means of biasing a charm and rivet away from one another, but into a locking engagement. Annular washers of suitable sizes, shapes, resiliency, hardness and durability are commercially available as off-the-shelf components. Thus, the biasing member of this apparatus need not be custom manufactured at high cost. Further, and annular washer can be easily installed upon the stem, and can be readily removed and replaced, if and when needed. Also, the need to manipulate a spring, or a tiny elastically compressible disc or ball, for insertion into a hollow shaft (with difficulty and precision), is entirely avoided.

Figure 5:
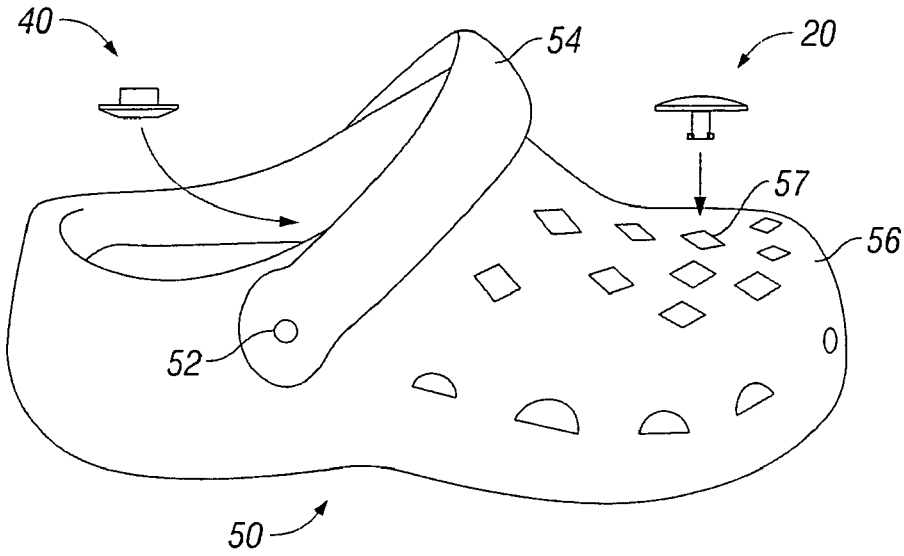
FIG. 5 is a side view of the apparatus, also illustrating the use of the apparatus in connection with a shoe.
Figure 6:
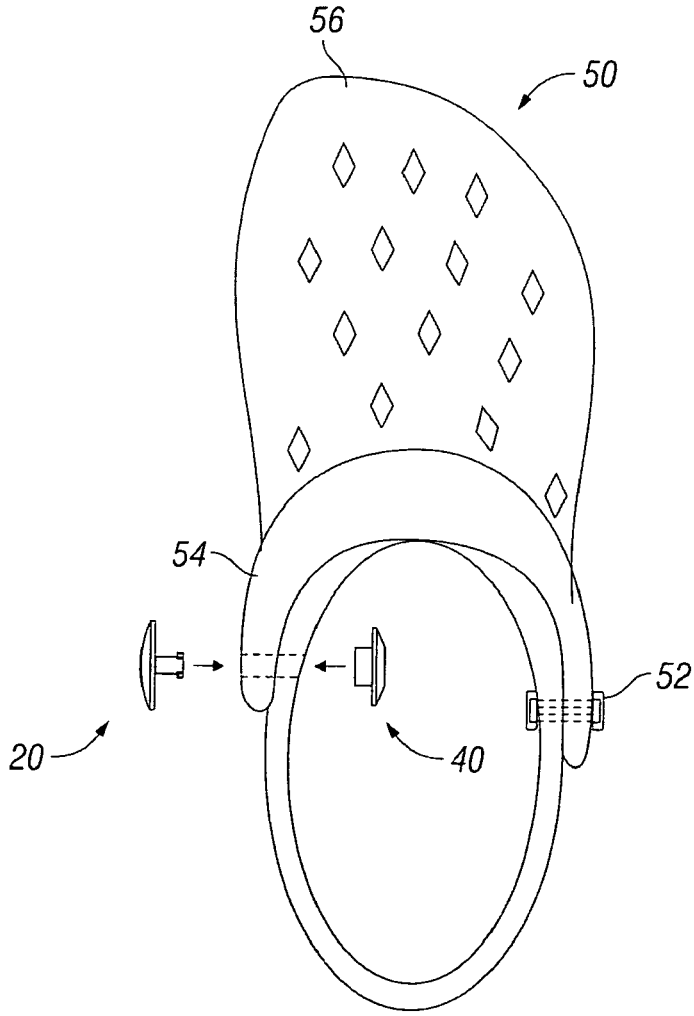
FIG. 6 is a top view of an apparatus according to the present invention, shown in relation to a shoe with which the apparatus may be used.

Attention is invited to FIGS. 5 and 6. The ornamental fastener system according to this disclosure is removably attachable to an item, and may be used in cooperation with footwear such as a shoe 50, a sandal-type shoe being shown in the drawing figures. Typically, an original rivet 52 is installed to attach each end of the strap 54 to the upper 56. As indicated in FIG. 5, the apparatus 20, 40 according to the present disclosure also may be installed by the user at positions upon the shoe 50, such as through a pre-existing hole 57 in the upper 56. Of course, a hole may be created by the user at some other location using a heavy-duty punch, leather awl, or the like, permitting the ornamental apparatus to be installed practically anywhere on the upper portion of a shoe. Alternatively, the apparatus 20, 40 may in instances be used to replace the stock rivet 52 installed at the time of shoe manufacture to connect the strap 54 to the upper portion 56 of the shoe, as suggested by FIG. 6.

In one mode of practicing the invention, therefore, the rivet 52 or other fastener installed by the shoe manufacturer is removed and replaced with the system 20, 40' according to the present disclosure.

In the practice of the invention upon a shoe 50 or some other item, the means and method may correspond to the general case depicted in FIG. 4. Whenever the item (pet collar, clothing lapel, hat, belt, purse wall or strap, etc.) is mostly flat and planar, but without much inherent elastic "give" or resiliency, the presence of the washer 60 urges the charm 20 to remain engaged with the base 40. Generally, therefore, there is disclosed in FIG. 4 a decorative fastener 20 mountable upon an item to be worn; the item to be worn by a user may be a shoe, an item of clothing (including shirts, hats and caps, or the like), or even a pet collar.

However, the apparatus may be practiced with success upon items manufactured from elastically compressible materials, and without the need to utilize a separate washer 60. In those instances where the item (i.e., a rubber or resilient plastic clog or shoe) itself exhibits substantial elastic compressibility, the item itself acts in lieu of the washer 60. The washer may be omitted, and the item itself provides the compression of the charm 20 against the base 40 to promote their secure but releasable connection.

Referring to FIGS. 5 and 6, the apparatus features the base portion 40 and the charm 20 engageable with the charm, with the item (such as shoe 50) situated between the charm 20 and base 40. In such instances, the compressible substance of the shoe 50 (including the strap 54 as appropriate), instead of a compressible washer, is squeezed between the charm 20 and the base 40 while the twisting interlock is engaged or disengaged. When the apparatus is installed through a hole 57 in the shoe with the stubs 25, 25' situated in the notches 55, 55' of the base 40, the resilient rebound of the compressed material of the shoe provides the compressive force that releasably holds the charm 20 and base 40 together, as previously described above. A variety of decorations 20 accordingly may be used in combination with the shoe or other item.

Typically, there will be offered at least two interchangeable charm portions 20 with decorations thereon. The decoration on any particular charm 20 typically will differ from the decoration on other ornament portions. Thus, the user can select which decoration to use upon the shoe or other item, because any selected one of the charms 20 is temporarily attachable to the base 40. When the apparatus is fully and properly installed on the shoe 50 or other item, the charm portion 20 thus performs its decorative function on the outside of the shoe, or is ready to accept added charms or other removably attachable decorative items thereon.

Notably, the charm 20 can easily and quickly be removed and replaced with another such portion bearing some other decorative insignia or imagery. Thus, the availability of a selection of interchangeable charms 20 permits a user to remove and replace ornamental charms on her shoes on a frequent basis; the various interchangeable charm portions 20 can be serially removed and replaced, and removed again, to vary the decorative appearance of the apparatus. And again, the top or upper surface 23 of the charm 20 may be painted or engraved, or have enamel covering that is painted or inked, or it may bear an engraved insignia, design, or image of nearly any variety or subject matter. It may be colored, or be metallic.

Attention now is invited to FIGS. 7-11, which collectively disclose a further embodiment of an ornamental fastener system especially for shoes. This alternative embodiment provides a means for providing interchangeable ornamentation that is attachable to the laces of a shoe.

Figure 7:
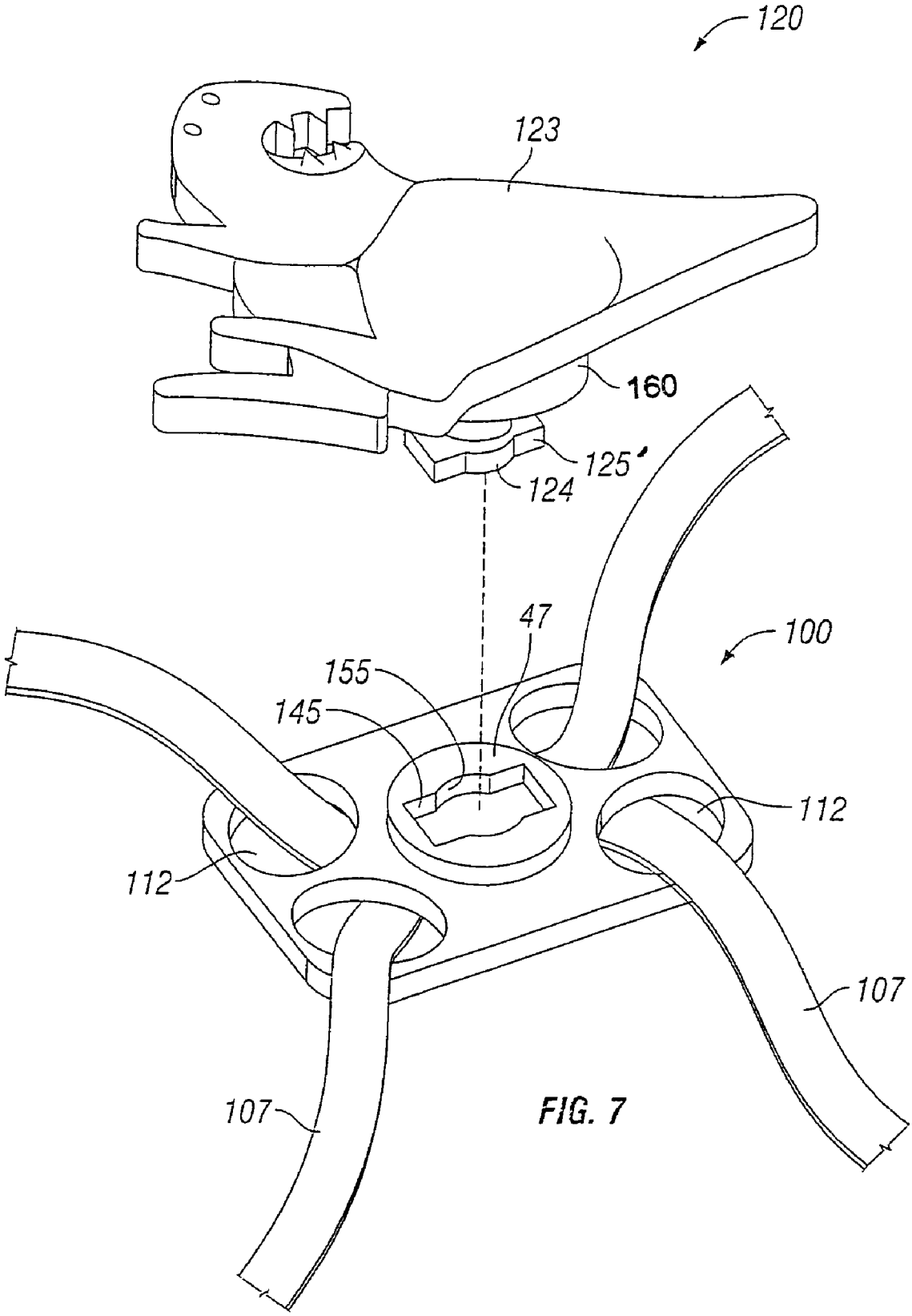
FIG. 7 is an enlarged, perspective, exploded view of an alternative embodiment of the apparatus of the invention, useable in conjunction with the laces of a shoe.
Figure 8A:
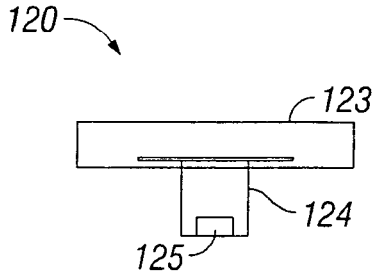
FIG. 8A is an enlarged left side elevation view of a charm member useable in the embodiment of the apparatus seen in FIG. 7.
Figure 8B:
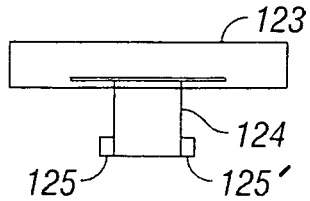
FIG. 8B is a front elevation of the charm member seen in FIG. 8A.
Figure 11:
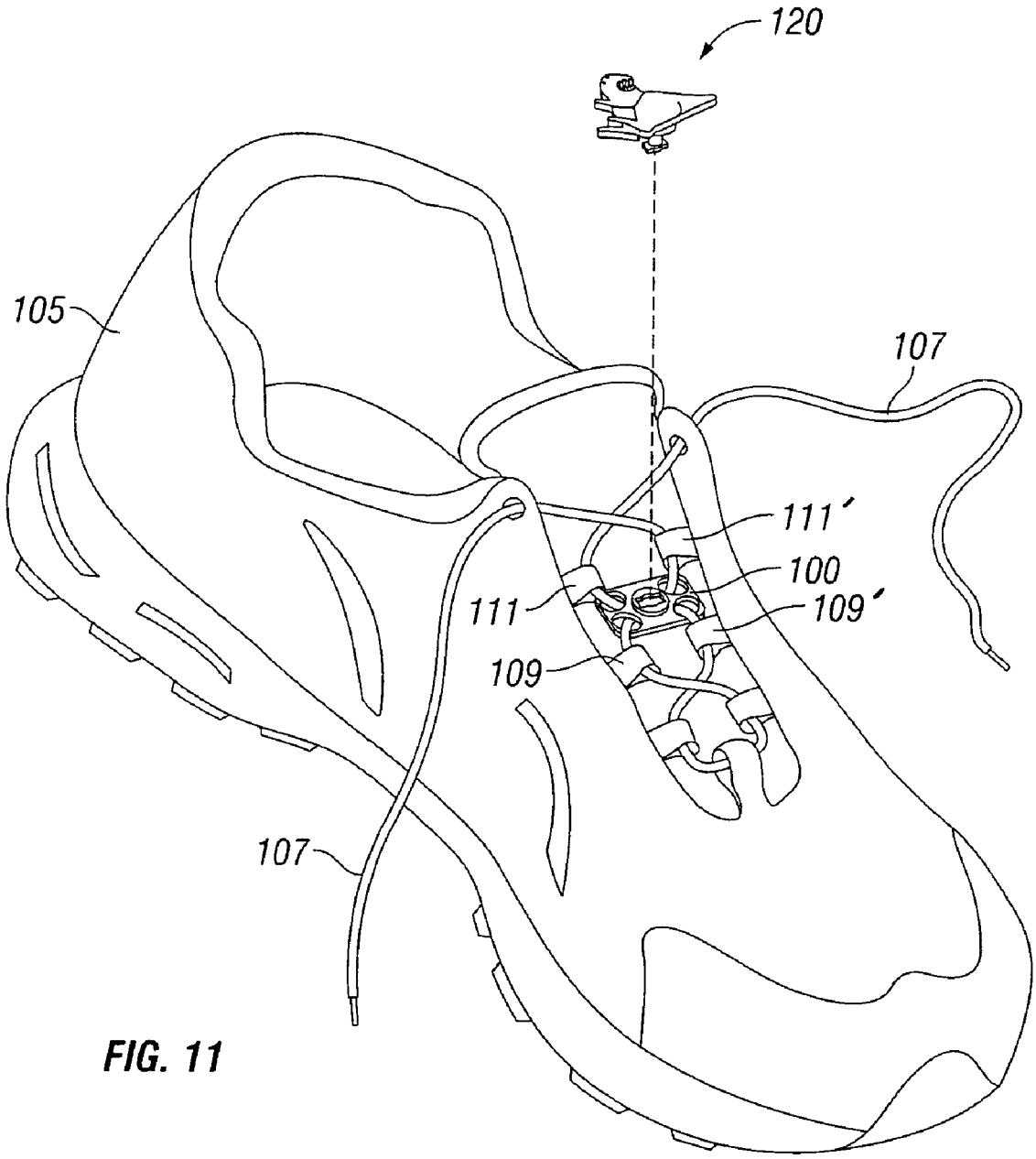
FIG. 11 is a top perspective, partially exploded view of the apparatus of the invention seen in FIG. 7, showing how it may be attached to a shoe by using the shoelaces, the attachment of the charm to the base members being suggested by the dashed line.

This alternative embodiment of the apparatus is devised for use in combination with a shoe 105 having any variety of flexible shoelaces 107 as seen in FIG. 11. The shoelaces 107 are disposed through the eyelets 109, 109' (eyelets may be of any ordinary type known in the art) of the shoe in a criss-cross manner generally according to convention. The base 100 is removably attached to the shoe 105 by means of the laces 107; the respective ends of the laces are passed through a first pair 109, 109' of shoe eyelets, then through pairs of lace apertures 112 in the base 100, and then through a second pair 111, 111' of shoe eyelets as seen in FIGS. 7 and 11 and in a manner to be further described. It is contemplated that the base 100 in use is disposed between adjacent pairs of eyelets 109, 109' and 111, 111', as seen in FIG. 11.

Combined reference to FIGS. 7 and 11 shows that this embodiment of the apparatus includes two principal components, the base portion 100 and the charm portion 120. As suggested by FIGS. 8A and 8B, the charm 120 is configured substantially the same as the charm 20 in previously described embodiments, including the presence of the stem 124 with its pair of laterally extending distal stubs 125, 125'. The charm 120 in this embodiment functions substantially the same as in all previous embodiments. These charm 120 and base 100 components may be fashioned from any substantially rigid material, preferably injection-molded plastic or metal alloy.

Figure 9A:
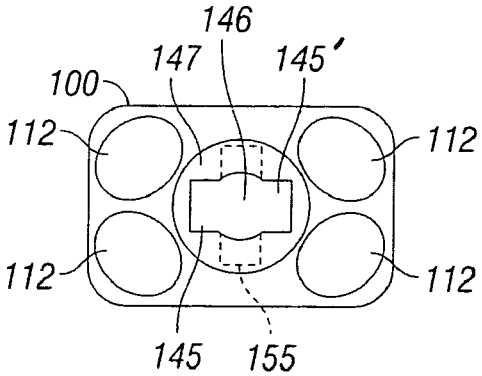
FIG. 9A is an enlarged top plan view of the base member of the apparatus depicted in FIG. 7.

The base portion 100 preferably includes a base flange portion having a generally rectangular oblong shape when viewed from above, as seen in FIG. 9A. In front elevation view (FIG. 10A), the base flange of base 100 has the shape of a relatively thin chip with a slightly curved profile, the top being slightly convex and the bottom being slightly concave. Such curvature is to promote a comfortable, substantially flushly conforming fit of the base 100 upon the tongue of the shoe 105, as seen in FIG. 11. By way only of illustrative example, the base portion 100 may have overall dimensions of about 19 mm long, 8 mm wide, and about 4 mm in profile height dimension.

Figure 9B:
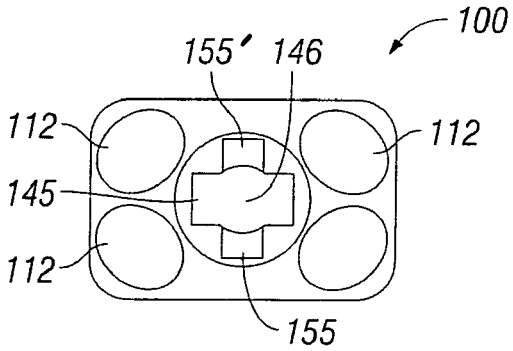
FIG. 9B is a bottom view of the base member of the apparatus depicted in FIG. 9A.
Figure 10A:
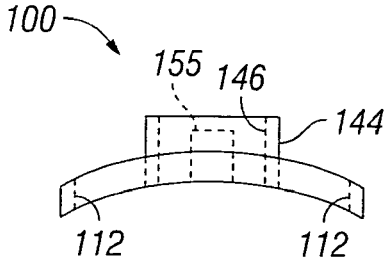
FIG. 10A is a front view of the base member of the apparatus depicted in FIG. 9A.
Figure 10B:
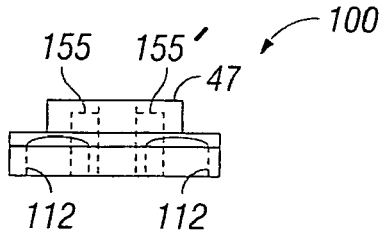
FIG. 10B is a left side elevation view of a base member of the apparatus depicted in FIG. 10A.

From the base 100 extends its broader flange portion, through which are defined two pairs of lace apertures 112. The lace apertures 112 preferably are defined through corners of the flange of the base, as best seen in FIGS. 7, 9A and 9B. The lace apertures 112 may be oval as seen in FIGS. 9A and 9B, or any other shape, provided the dimensions of each lace aperture permit a shoelace 107 to pass smoothly therethrough. The lace apertures 112 fully penetrate the base portion, as also indicated by FIGS. 10A and 10B.

Central to the base and situated amongst the lace apertures 112 is the connector portion of the base 100, including the coupling body 144 and associated elements. It will be readily apparent that the base 100 is similar in form and function to the base 40 of previously described embodiments.

The coupling body 144 preferably is generally cylindrical in shape, and projects from the center of the top of the base 100. As in previous embodiments, the coupling body 144 has a central tunnel-like aperture 146 running its axial length, into which the stem 124 of the charm 120 can be inserted, whereby to connect the charm 120 to the base rivet 100. As best seen in FIGS. 9A, 9B, 10A and 10B, the shaft aperture 146 has a central circular portion and a pair of parallel, diametrically opposed, grooves or channels 145, 145' axially coextensive with the central circular portion. The diameter of the circular central portion of the aperture 146 is slightly less than, but corresponds closely to, the diameter of the stem 124 of the charm 120. And once again, the plan shape and size of the aperture grooves 145, 145' correspond generally to the exterior plan contours of the stem stubs 125, 125'. Consequently, when the stubs 125, 125' are placed in registration with the aperture grooves 145, 145', and the stem 124 is aligned with the axis of the aperture 146, the charm's stem 124 can be smoothly inserted into the aperture 146. The overall length of the stem 124 is about equal to, or more preferably slightly less than, the total height of the base rivet 100 component. When the stem 124 is maximally inserted into the aperture 146 (i.e., when the top end 47 of the coupling body 144 butts against the underside of the charm head), the distal end of the stem 24 preferably is approximately flush with the bottom of the base 100.

Attachment and detachment of the charm 120 to and from the base 100 is generally in accordance with the means and modes described hereinabove with respect to the embodiment of FIGS. 1-4. It shall be noted, and as shown in FIG. 7, this version of the apparatus employs an elastically compressible washer 160 situated upon the stem 124, in accordance with previously described embodiments.

By means of the twisting, interlocking temporary connection provided between the charm 120 and base 100, the ornamental charm 120 can alternately and repeatedly attached to and detached from the base portion 1100, permitting selective interchangeability between and among an assortment of different ornament portions.

The utility of the fastener 100 is apparent from the foregoing, but further disclosed by reference to FIGS. 7 and 11. It is seen that the respective ends of a shoelace 107 already disposed through the lower eyelets of a shoe are passed up and through corresponding ones of the lace apertures 112 of the base portion 100, and then to disposition through a next upper pair of eyelets. The each free end of the lace 107, being disposed through the lace apertures 112 of the base portion 100, are passed through the next pair of adjacent eyelets in the shoe, ad the shoe then fully laced for use as seen in FIG. 11. The passage of each of the laces 107 through the apertures 112 may be in an "over-under-over" from the aperture in one corner of the base to an aperture in the diagonally opposite corner, as indicated in FIG. 7. However, this is only by way of illustration, and a myriad of different schemes for running the laces 107 through the apertures 112 can be readily devised, appreciated, and implemented.

An advantage of this embodiment is that the charm 120 is removably connected to the base 100 by simply inserting the stem 124 into the attachment aperture 1146, and rotating the charm to lock it into place upon the base portion 112. This connection is reversible by depressing and counter-rotating the charm, as described previously. The user accordingly may select from a variety decorative charms to suit his or her taste at a particular time, and place a specific chosen ornament portion (with the desired decorative element, emblem, charm or the like thereon) onto the base portion 100 without having to unlace the shoe 105 and remove the base portion from its situation on the laces and between pairs of eyelets. Of course, the user is always free to remove the apparatus 100, 120 by the simple expedient of unlacing the shoe.

Figure 12:
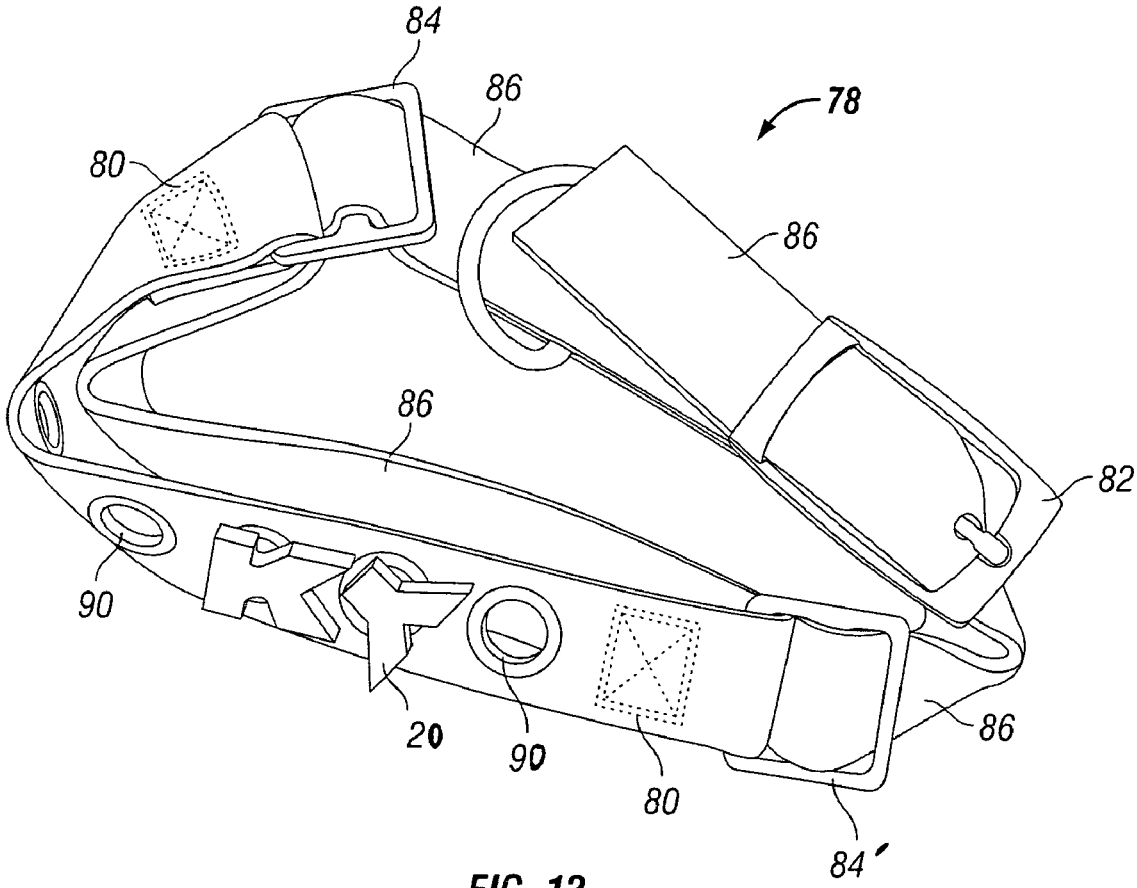
FIG. 12 is a top perspective view of a pet collar embodiment of the apparatus according to the present disclosure, showing a charm crown and a collar strap interconnected for use upon the neck of a pet, there being a charm removably attached to the charm crown.

Reference is now made to FIG. 12, showing yet another embodiment of the apparatus and method according to the present disclosure. There is disclosed thereby a decorative fastening system 78 for use as a collar (whether of natural or synthetic materials) to be worn by a pet. The collar preferably is comprised of two strap components with accompanying buckles or other means for interconnection. The decorative pet collar system 78 features the charm and base parts that may be connected together on opposite sides of the collar, with a collar crown strap situated between the charm part and base part of the system previously described hereinabove.

The collar strap is largely conventional, while the charm crown is a flexible segment of strap having buckles on each end, and intermediate holes for the placement of the charm rivet previously disclosed herein. Both the strap collar and the charm crown may be provided in a variety of colors and sizes. Sizes may be customized to the various sizes of pet breeds, e.g., the larger the dog or cat (or other mammal pet), the larger the disclosed system should be.

In the practice of the apparatus 78 and its method of use, the user first weaves the collar strap though a buckle on one end of the charm crown. The user continues by pulling the collar strap through a first buckle on one end of the charm crown, and then weaves the strap through a second buckle on the opposite end of the charm crown. Once the charm crown is thus attached to the collar strap, the user can slide the charm crown to the desired location along the length of the collar strap. The decorative charm rivets can then be placed in any or all the charm holes in the charm crown, which holes are adapted to receive securely the charms, all as shall now be described.

The pet collar embodiment of the system and apparatus 78, fully assembled, is seen in FIG. 12. The pet collar according to this disclosure has a collar strap 86 and a charm crown 80. The collar strap 86 and charm crown 80 are lengths of flexible strap fabricated from any suitable material, such as woven nylon webbing or leather. The collar strap 86 has a length, width and thickness corresponding generally to conventional collars known in the art. The collar strap 86 may be provided with buckle pin holes at spaced intervals there-through, and with a buckle 82 (e.g., metal) also in accordance with convention, for temporarily connecting the ends of the collar strap together as seen in FIG. 12. There may also be an auxiliary holder loop (seen in FIG. 12) connected to or mounted on the collar strap, through which an end of the collar strap 86 may be fed—again, as known in the art—for holding the free end of the strap when the ends are releasably attached together with the buckle 82.

There also is provided a charm crown 80, which also is a flexible strap fabricated from any suitable material, such as woven nylon webbing or leather. The charm crown 80 has a length significantly less than the overall length of the collar strap 86; its total length in a typical embodiment of the apparatus will be substantially less than the circumference of the pet's neck. The charm crown 80, however, preferably has a width and thickness corresponding generally to the collar strap 86.

Figure 12A:
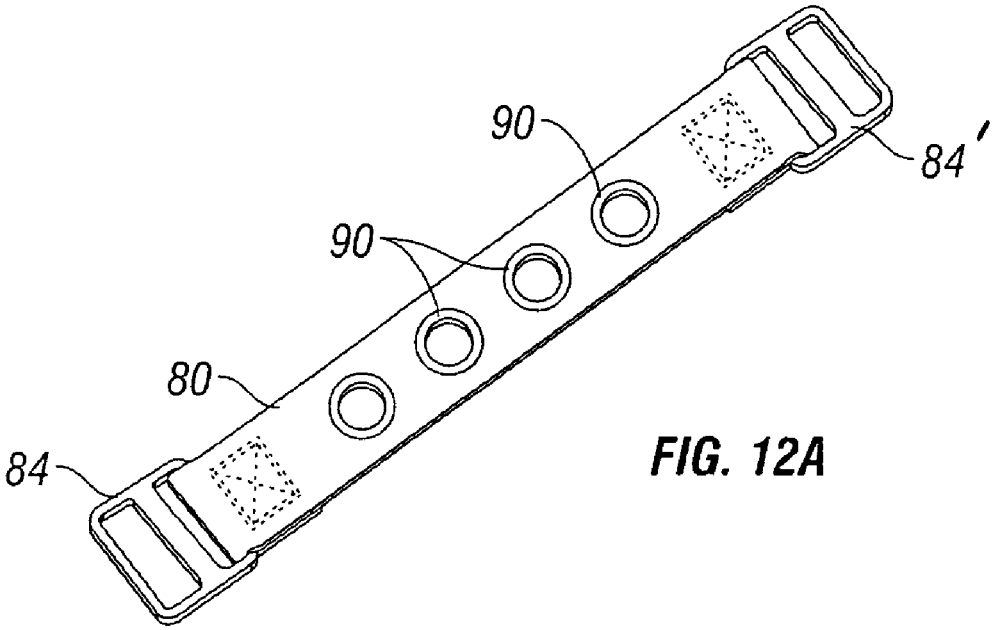
FIGS. 12A-12L are a series of illustrations showing enlarged portions of the pet collar embodiment seen in FIG. 12, depicting steps in the practice of the pet collar embodiment according to the present disclosure.
Figure 12B:
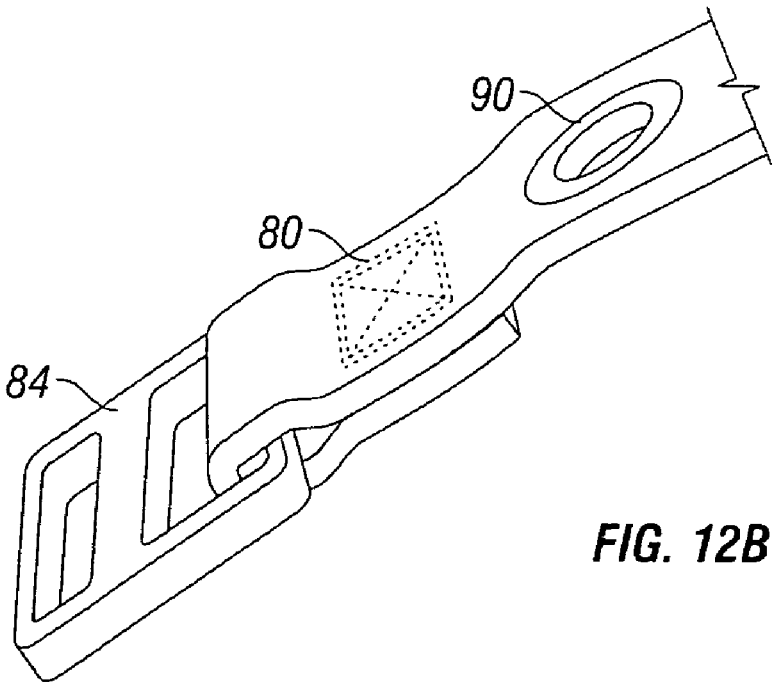

Attachment loops 84 or 84', preferably but optionally composed of a durable metal, are securely, even permanently, mounted on each end of the charm crown 80. As suggested in FIG. 12B, for example, each attachment loop 84, 84' preferably is a ladder-loop connected to an end of the charm crown 80. A ladder-loop has at least two adjacent apertures defined by a rigid unitary frame, as seen in FIGS. 12A and 12B. An attachment loop 84 or 84' can be mounted to the end of the charm crown simply by feeding the end of the charm crown through one opening in the attachment loop 84, 84', doubling the end of the crown back over against itself into flush contact, and sewing the end of the crown to the crown itself.

As also seen in FIGS. 12 and 12A, the charm crown 80 is provided with at least one, preferably a plurality, of charm holes 90 there-through. The charm holes 90 are defined at spaced intervals along a significant length of the charm crown 80. The charm holes 90 preferably are defined and reinforced with metal or plastic grommets, as indicated in FIG. 12. As shall shortly be further explained, the charm holes 90 are provided to permit releasable connection of one or more interchangeable charms 20 upon the charm crown 80. The charms 20 are substantially similar in form and function to the charms 20, 120 described herein for previously disclosed embodiments.

Attention is invited to FIGS. 12A through 12L, being illustrations of the steps of the practice of the apparatus using the charm crown 80 and collar strap 86. FIG. 12A shows a charm crown 80 which is selected by the user according to a desired length and color, etc. The charm crown 80 has one or more reinforced charm holes 90 defined completely there-through, and an attachment loop 84 or 84' at each end.

Figure 12C:
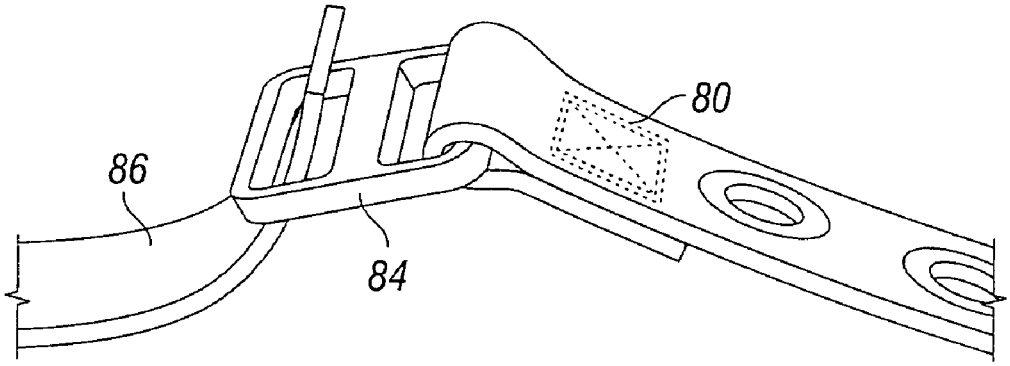
Figure 12D:
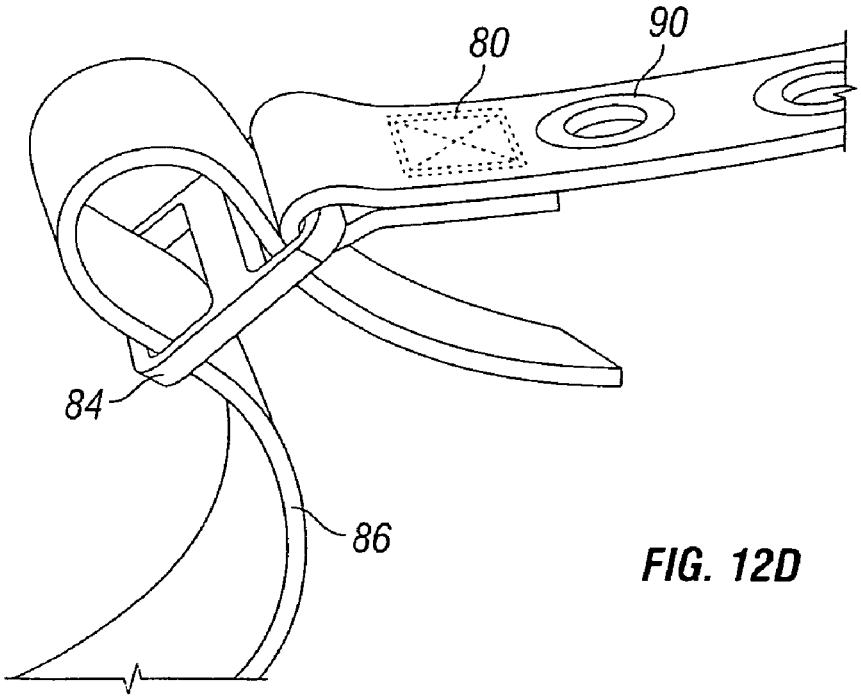
Figure 12E:
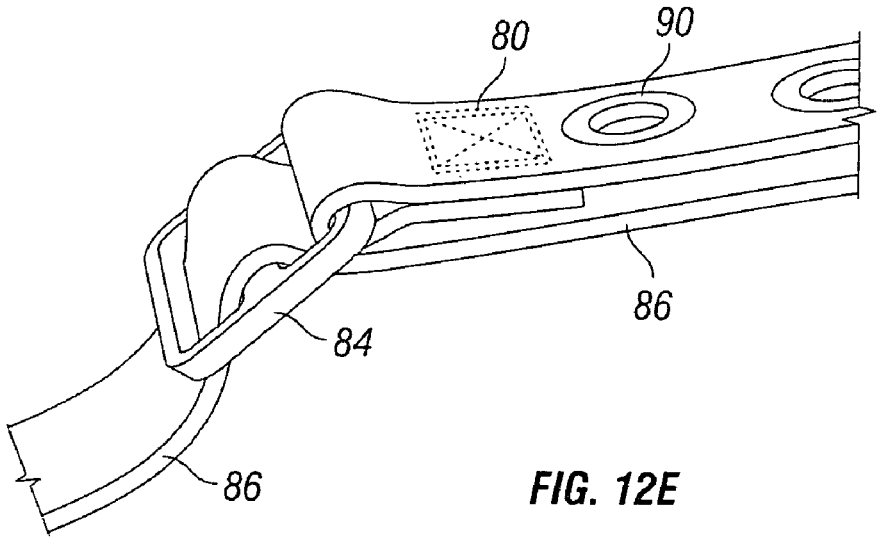

The user begins by selecting a charm crown 80 and collar 86, which preferably but not necessarily are of the same color, thickness and width, chosen from an assortment of colors. Next (FIG. 12B), the user selects a first attachment loop 84 on one end of the charm crown 80. As seen in FIG. 12C, the user inserts a first tip of the collar strap 86 into a first opening in the first attachment loop 84 on the first end of the charm crown 80. Next, the user pulls the collar strap 86 through the first opening in the buckle, then inserts the first tip of the collar strap 86 into the second opening in the buckle, as seen in FIG. 12D. The collar strap 86 is then "fed" along and parallel to the underside of the charm crown 80. Referring to FIG. 12E, it is seen that the charm crown 80 can then be slid (feeding the strap 86 through the first charm crown attachment loop 84) to the desired location along the length of the strap collar 86 itself. Typically, the charm crown 80 ultimately will be situated symmetrically intermediate along the collar strap 86, that is, equal lengths of the collar strap will extend beyond the ends of the charm crown.

Figure 12F:
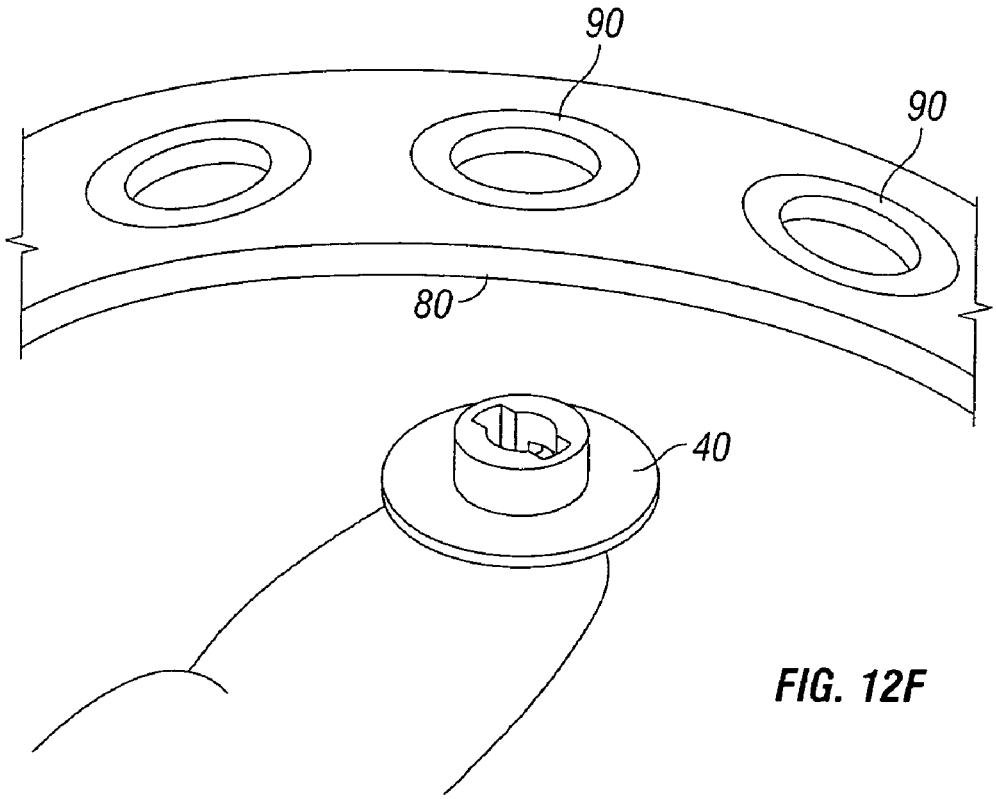
Figure 12G:
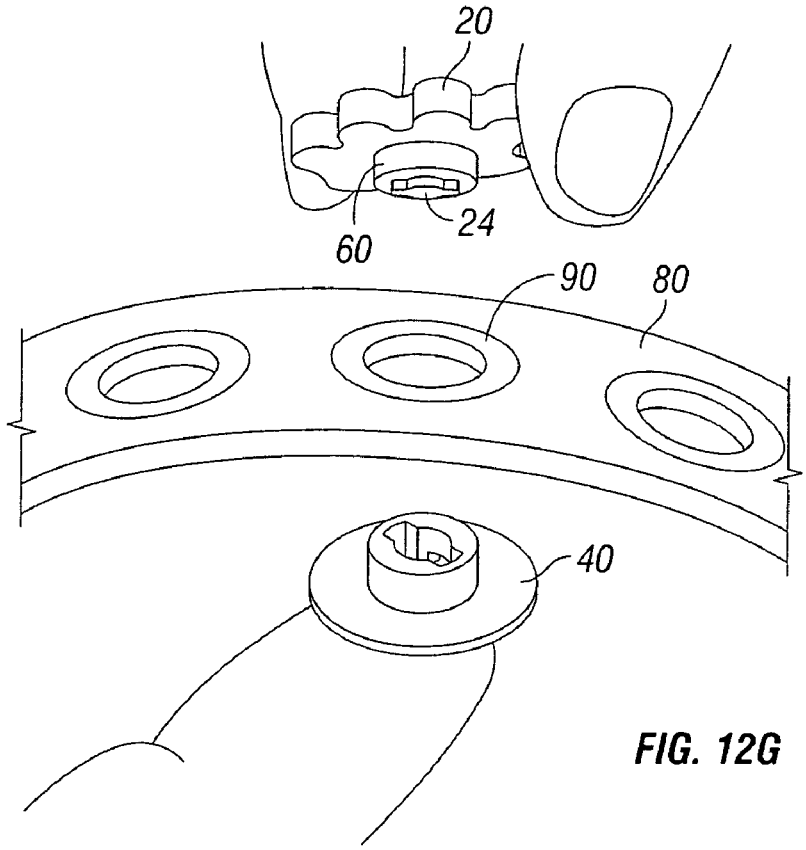
Figure 12H:
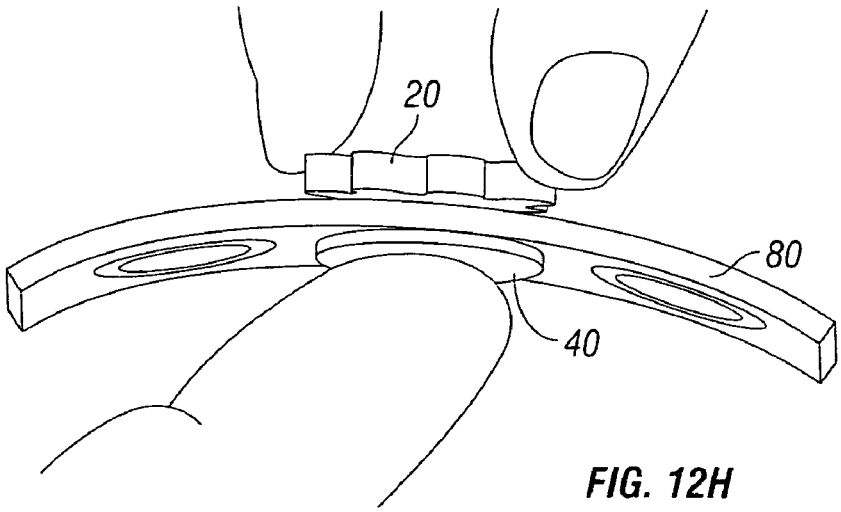

With the charm crown 80 thus engaged with a first end of the collar strap 86, the user takes in hand the base 40 or "charm lock" component of the apparatus (as previously described herein), and inserts it into any chosen one of the charm holes 90, as seen in FIG. 12F. As seen in FIG. 12G, while holding the base 40 to keep it in the charm hole 90 in the charm crown 80, the user inserts the stem 24 of the charm 20 through the corresponding hole 90 in the charm crown, and into the aperture in the base 40. While holding the base 40 in place, the user presses down on the charm 20 to compress the elastic washer 60, and twists the charm ninety degrees, to engage and lock the two pieces 20 and 40 of the apparatus, as described hereinabove with respect to FIGS. 1-4. Any number of charms 20, up to the total number of charm holes 90 in the charm crown 80 thus can be temporarily connected upon the charm crown.

Figure 12I:
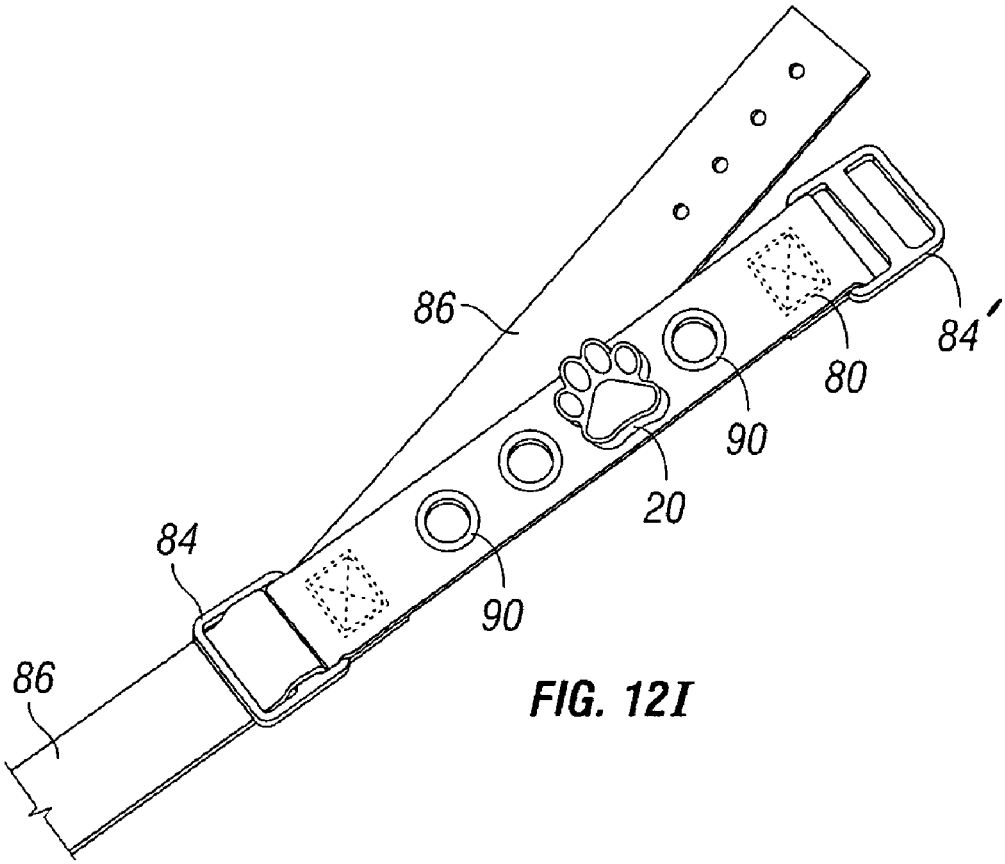
Figure 12J:
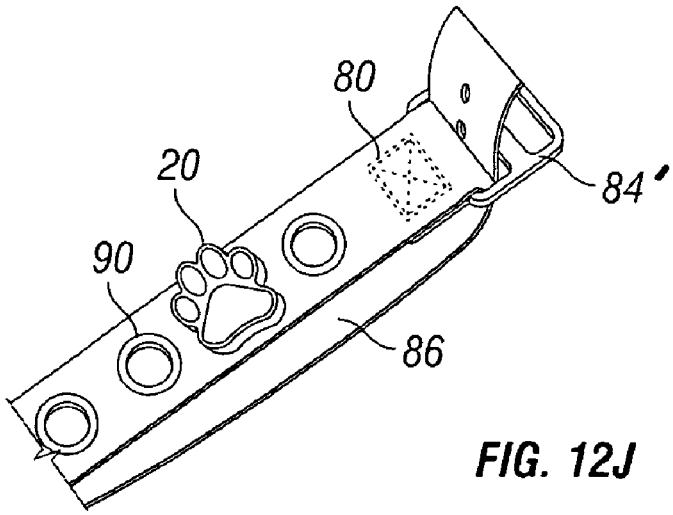
Figure 12K:
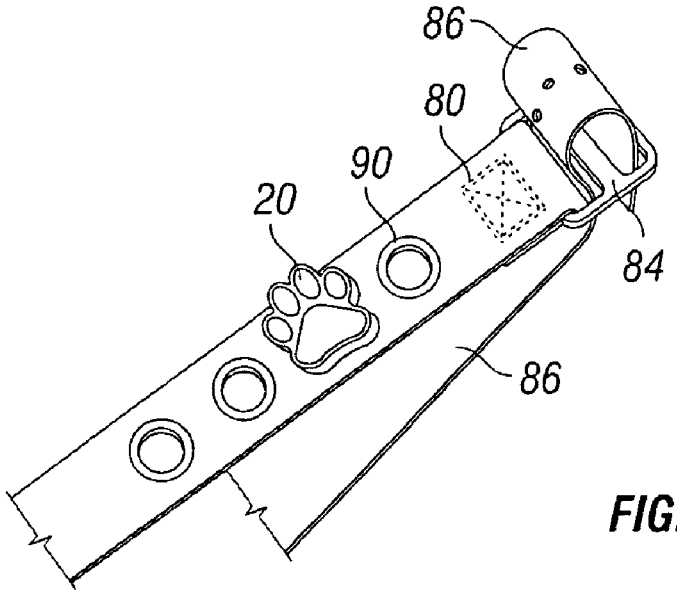
Figure 12L:
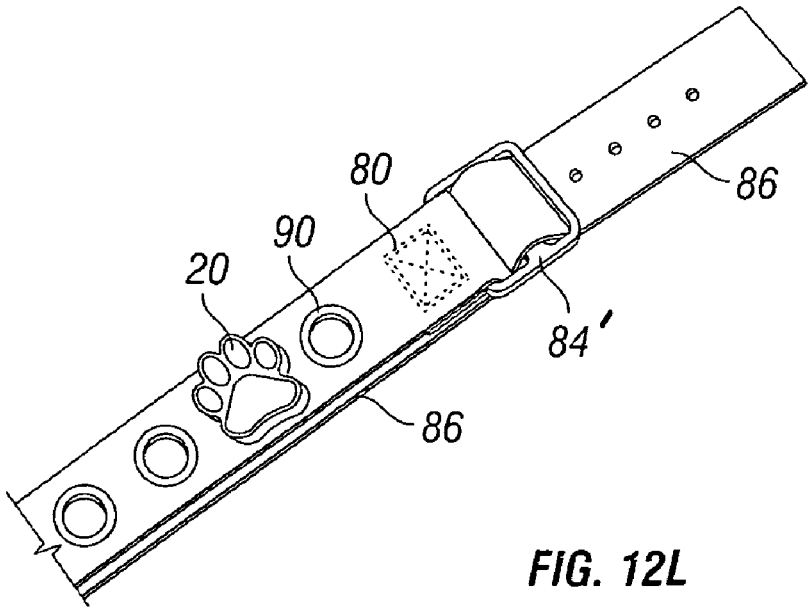

After the user has completed attaching one or more charms 20 to the charm crown 80, he or she continues securing the charm crown 80 to the collar strap 86, to slide it into proper relative position as shown in FIG. 12I. Then, as depicted in FIG. 12J), the user takes the first tip of the collar strap 86 and inserts into the first opening (closest to the charm crown 80) in the other, second attachment loop 84 on the other, second, end of the charm crown 80. The strap collar 86 is pulled through the first opening in the second attachment loop 84, as shown in FIG. 12K, and the first tip of the collar strap 86 then is inserted through the second opening in the second attachment loop 84. The collar strap 86 is then pulled through the second attachment loop 84, as suggested by FIG. 12L, so that the charm crown 80 is well-attached to the collar strap 86. The user may then adjust the charm crown 80, in positional relation to the collar strap 86, so that the crown (with charm(s) 20 thereon) is in the position that looks best upon the dog or other pet. The ends of the collar strap 86 can then be wrapped around the pet's neck, as appropriate and known in the art, and secured using the buckle 82.

A noteworthy advantage of the immediately foregoing pet collar embodiment of the disclosed apparatus is comfort to the pet. It is noted that when the apparatus is properly installed upon a pet, the smooth collar strap 86 is situated between the base(s) 40 on the charm crown and the animal's skin or fur. The collar strap 86 prevents the base(s) 40 from poking or irritating the animal while the apparatus is worn. Also, the animal's fur is much less prone to become entangled with the base(s) 40 and/or stem(s) 24 of the charm system. The pet will not resist wearing the apparatus, as only soft, smooth, flexible surfaces of the collar strap come in contact with the animal, while the charms 20 remain readily attachable, detachable, and interchangeable.

It will be quickly appreciated that the above disclosure is of a preferred embodiment only; other embodiments may be fashioned without departing from the spirit of the invention. For example, the decorative or ornamental features of the stem may instead be disposed on the base rivet; in other words, the roles of the base and rivet may be reversed, so that the decorative or ornamental features are upon the "base rivet" (having a coupling body) rather than the "charm" having a stem.

The use of an annular washer 60 disposed concentrically about the stem 24 of the charm 20 offers advantages over other possible means of biasing a charm and rivet away from one another, but into a locking engagement. Annular washers of suitable sizes, shapes, resiliency, hardness and durability are commercially available as off-the-shelf components.

Thus, the biasing member of this apparatus need not be custom manufactured at high cost. Further, and annular washer can be easily installed upon the stem, and can be readily removed and replaced, if and when needed. Also, the need to manipulate a spring, or a tiny elastically compressible disc or ball, for insertion into a hollow shaft (with difficulty and precision), is entirely avoided.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

The invention claimed is:

1. A decorative apparatus removably attachable to an item to be decorated, said apparatus comprising:

a charm comprising:

a head;

a stem extending a stem length from a bottom of said head; and at least one stub extending laterally from a distal end of said stem;

an elastically compressible member disposable around said stem; and a base comprising:

a base flange;

a coupling body extending a shaft length from said flange;

a tunnel-like aperture, along said shaft length, into which said stem is insertable, said aperture comprising:

a central portion along a central axis; and at least one side groove axially coextensive with said central circular portion, into which said at least one stub is slidably engageable;

a recess defined in a bottom of said base, said aperture opening into said recess;

at least one notch defined in a floor of said recess, said at least one notch substantially corresponding in shape and size to said at least one stub on said stem, and said notch being angularly offset in relation to said at least one channel;

wherein when said at least one stub is placed in registration with said at least one groove and said stem is aligned with said aperture axis, said stem is insertable into said aperture; and wherein when said stem is fully inserted into said aperture, said compressible member is compressible between said charm head and said base; and wherein when said stem is fully inserted into said aperture, said stem is rotatable in said aperture and said at least one stub is rotatable in said recess to align and engage said stub with said at least one notch, thereby to releasably connect said charm to said base.

2. An apparatus according to claim 1 wherein:

said at least one stub comprises a pair of stubs extending diametrically opposite each other from said stem;

said at least one groove comprises a pair of grooves diametrically opposite each other along said central portion of said aperture; and said at least one notch comprises a pair of notches extending diametrically opposite each other from said central portion of said aperture, both said notches being angularly offset from said pair of grooves.

3. An apparatus according to claim 1 wherein said elastically compressible member comprises a resilient washer.

4. An apparatus according to claim 3 wherein said washer comprises silicone.

5. An apparatus according to claim 3 wherein said elastically compressible member comprises a material having a hardness of between about 35 durometer and about 45 durometer.

6. An apparatus according to claim 1 wherein said elastically compressible member comprises the item to be decorated.

7. An apparatus according to claim 1 wherein said base comprises a flange portion through which are defined at least one pair of shoelace apertures.

8. An apparatus according to claim 7 wherein said base flange is generally rectangular, and comprising four shoelace apertures, one said aperture defined each corner of said base flange portion.

9. An apparatus according to claim 1 wherein the item to be decorated comprises a pet collar comprising:

a flexible collar strap;

a charm crown strap having at least one charm hole defined there-though;

a pair of attachment loops, one said attachment loop mounted at each end of said charm crown strap;

wherein said flexible collar strap is disposable through said attachment loops thereby to connect said collar strap in flush, substantially parallel adjacency with said charm crown strap; and wherein said charm stem is insertable through said at least one charm hole, whereby when said charm is releasably connected to said base, said charm is temporarily attached upon said charm crown strap.

10. A decorative apparatus removably attachable to an item to be decorated, said apparatus comprising:

a charm comprising:

a head;

a stem extending a stem length from a bottom of said head; and at least one stub extending laterally from a distal end of said stem;

an elastically compressible member comprising a resilient washer disposed around said stem; and a base comprising:

a base flange;

a coupling body extending a shaft length from said flange;

a tunnel-like aperture, along said shaft length, into which said stem is insertable, said aperture comprising:

a central portion along a central axis; and at least one side groove axially coextensive with said central circular portion, into which said at least one stub is slidably engageable;

a recess defined in a bottom of said base;

at least one notch defined in a floor of said recess, said at least one notch substantially corresponding in shape and size to said at least one stub on said stem, and said notch being angularly offset in relation to said at least one channel;

wherein when said at least one stub is placed in registration with said at least one groove and said stem is aligned with said aperture axis, said stem is insertable into said aperture; and wherein when said stem is fully inserted into said aperture, said compressible member is compressible between said charm head and said base; and wherein when said stem is fully inserted into said aperture, said stem is rotatable in said aperture and said at least one stub is rotatable in said recess to align and engage said stub with said at least one notch, thereby to releasably connect said charm to said base.

11. An apparatus according to claim 10 wherein:

said at least one stub comprises a pair of stubs extending diametrically opposite each other from said stem;

said at least one groove comprises a pair of grooves diametrically opposite each other along said central portion of said aperture; and said at least one notch comprises a pair of notches extending diametrically opposite each other from said central portion of said aperture, both said notches being angularly offset from said pair of grooves.

12. An apparatus according to claim 10 wherein said washer comprises silicone.

13. An apparatus according to claim 10 wherein said resilient washer comprises a material having a hardness of between about 35 durometer and about 45 durometer.

14. An apparatus according to claim 10 wherein said elastically compressible member comprises the item to be decorated.

15. An apparatus according to claim 10 wherein said base comprises a flange portion through which are defined at least one pair of shoelace apertures.

16. An apparatus according to claim 15 wherein said base flange is generally rectangular, and comprising four shoelace apertures, one said aperture defined in each corner of said base flange portion.

17. An apparatus according to claim 10 wherein the item to be decorated comprises a pet collar comprising:

a flexible collar strap;

a charm crown strap having at least one charm hole defined there-though;

a pair of attachment loops, one said attachment loop mounted at each end of said charm crown strap;

wherein said flexible collar strap is disposable through said attachment loops thereby to connect said collar strap in flush, substantially parallel adjacency with said charm crown strap; and wherein said charm stem is insertable through said at least one charm hole, whereby when said charm is releasably connected to said base, said charm is temporarily attached upon said charm crown strap.

* * * * *